US011846065B2

(12) United States Patent
Roper

(10) Patent No.: US 11,846,065 B2
(45) Date of Patent: Dec. 19, 2023

(54) METHOD FOR DELIVERING PROPER AMOUNTS OF BLEACH AND MILL DYE TO DISCOLORED REGIONS OF A CARPET USING A ROLLER-BALL APPLICATOR

(71) Applicant: Jerry Gordon Roper, Payson, UT (US)

(72) Inventor: Jerry Gordon Roper, Payson, UT (US)

( * ) Notice: Subject to any disclaimer, the term of this patent is extended or adjusted under 35 U.S.C. 154(b) by 363 days.

(21) Appl. No.: 16/997,927

(22) Filed: Aug. 19, 2020

(65) Prior Publication Data

US 2021/0054562 A1 Feb. 25, 2021

Related U.S. Application Data

(60) Provisional application No. 62/888,983, filed on Aug. 19, 2019.

(51) Int. Cl.
*D06L 4/26* (2017.01)
*D06L 4/75* (2017.01)

(52) U.S. Cl.
CPC . *D06L 4/75* (2017.01); *D06L 4/26* (2017.01)

(58) Field of Classification Search
CPC ..... D06L 4/75; D06L 4/26
See application file for complete search history.

(56) References Cited

U.S. PATENT DOCUMENTS 5,759,439 A * 6/1998 Kott ..... C11D 3/33 252/186.25
6,533,824 B1 * 3/2003 Roper ..... D06P 3/06 8/441
7,727,289 B2 * 6/2010 Frazee ..... D06P 1/5285 8/558
2005/0227893 A1 * 10/2005 Johnson ..... C11D 3/162 510/367
2009/0304933 A1 * 12/2009 Conley ..... D06P 1/0016 524/556

FOREIGN PATENT DOCUMENTS

WO WO 01/04259 * 1/2001 ..... C11D 17/04

OTHER PUBLICATIONS

The Fix Bleach Spots w/ Carpet Dye Pens video by Americolordyes (https://www.youtube.com/watch?v=0pesFDeYhd8) Mar. 27, 2012.*
Spot N' Gone https://www.amazon.com/Carpet-Spot-Dye-Pens-Roller-Ball/dp/B07WQV2KWZ/ref=sr_1_2?crid=4MAZRQ6H0DOE&keywords=rollerball+carpet+dye+pen&qid=1655154334&sprefix=roller+ball+carpet+%2Caps%2C53&sr=8-2 Jun. 15, 2022.*
Home Dyers kit (https://www.youtube.com/watch?v=I6Risghyh3w&t=82s) Nov. 7, 2012.*
https://www.cancer.gov/publications/dictionaries/cancer-drug/def/sodium-thiosulfate Jun. 15, 2022.*

* cited by examiner

*Primary Examiner* — Amina S Khan
(74) *Attorney, Agent, or Firm* — Angus C. Fox, III

(57) ABSTRACT

A new method of delivering more precise amounts of carpet mill dye to regions of discoloration using a roller-ball applicator enables precisely metered delivery of the three primary dye colors to discolored carpet fibers. The method eliminates the need for a water extraction, enables the restoration of a more uniform color pattern, and eliminates dye overspray outside of the treated region that is inherent with the use of a spray bottle. The applicator is held with a loose grip and the roller ball is alternately moved in clockwise and counter-clockwise directions while in contact with the carpet fibers to be dyed. This ensures that dye is delivered to all sides of the fiber. To ensure even dye penetration and improved motion of the roller ball, an emulsifier is added to the dye solution. After each application, a microfilament cloth is wiped across the treated region.

18 Claims, 2 Drawing Sheets

METHOD FOR DELIVERING PROPER AMOUNTS OF BLEACH AND MILL DYE TO DISCOLORED REGIONS OF A CARPET USING A ROLLER-BALL APPLICATOR

BACKGROUND OF THE INVENTION

1. Field of the Invention

This invention relates generally to methods for spot dyeing nylon carpets and, more particularly, to methods for spot dyeing areas of such carpets that have been bleached.

2. History of the Prior Art

Until the middle of the nineteenth century, nearly all known dyes were obtained from natural sources. Although most were vegetable extracts, a few were animal products. The range of available colors was limited, as was the utility of the available dyes. If a specified natural dye did not bind to a particular material, that dye was ineffectual in changing the color of the material. The era of synthetic dyes began in 1771, when Woulfe prepared picric acid (a.k.a. trinitrophenol) by subjecting indigo to nitric acid. The resultant yellow crystalline solid proved to be a formidable explosive; when solvated, it was shown to dye silk in bright yellow hues. More than half a century passed before Laurent discovered in 1842 that phenol could be converted to picric acid. Fourteen years later, Perkin discovered mauve, a bluish purple dye obtained from aniline. Mauve, the first of the coal-tar dyes, was the first synthetic dye to be manufactured and used for practical dyeing. However, it was not until 1869, when the structure of benzene was established by Kekule, that the way was paved for the study of aromatic organic compounds, from which all synthetic dyes are synthesized. Since that time, a bewildering number of synthetic dyes have been formulated. New synthetic dyes are still being discovered with amazing regularity during the twenty-first century.

The largest group of dyes have as chromophores what are known as azo compounds—intensely colored aromatics having one or more azo linkages (—N═N—), each of which brings a pair of aromatic rings into conjugation. Each azo linkage gives an extended system of delocalized $\pi$ electrons that is responsible for absorption of light in visible regions. Depending on the number of azo groups present in the molecule, they are classified as monazo, diazo, triazo, tetrakisazo and polyazo dyes. Azo dyes almost always contain one or more $—SO_3^- Na^+$ groups, which not only confer water solubility on the dye, but assist in binding the dye to the surfaces of polar fibers, such as silk, wool, cotton, or nylon. Many dyes are made by coupling reactions of naphthylamines and naphthols. "H-acid" (8-Amino-1-naphthol-3,6-disulfonic acid) is a particularly versatile component in dye manufacture. Not only does it contain sulfonic acid groups, but it can also couple in two different ways, depending on the pH of the medium.

Silk and wool are two naturally occurring polymers that man has used for centuries to fabricate clothing and carpets. They are both examples of a family of polymer compounds, known as proteins, in which $\alpha$-amino acid subunits are joined by amide linkages. Proteins are, therefore, polyamides. The search for a synthetic material with properties similar to those of silk led to the discovery of a family of synthetic polyamides called nylons. One of the most important nylons, called nylon 6,6, can be prepared from the six-carbon dicarboxylic acid, adipic acid, and the six-carbon diamine, hexamethylene-diamine. In the commercial process, these two compounds are allowed to react in equimolar proportions in order to produce a 1:1 nylon salt. Water molecules are driven off by heating the nylon salt it to a temperature of 270° C. at a pressure of 250 pounds per square inch, thereby condensing it to the polyamide. The nylon 6,6 so produced, which has a molecular weight of about 10,000 and a melting point of about 250° C., can be spun into fibers when molten. By stretching the fibers to four times their original length, the polyamide molecules orient themselves so that they are parallel to the fiber axis. Such an orientation permits hydrogen bonding between carbonyl groups and amino groups on adjacent chains. This "cold drawing" process greatly increases the strength of the fibers.

The same molecular structure that is responsible for the strength of nylon fibers also results in repeating polarized units on the surface of each fiber. It is this polarization that allows nylon fibers to be readily colored by sulfonic-acid dyes. Typically, one or more organic acid dyes are dissolved in an aqueous solution and the material to be dyed is either sprayed with or immersed in the solution. The physical characteristics of nylon fibers which permit them to be readily dyed, also make them susceptible to staining. Certain FDA-approved food colorings work equally well as nylon fiber dyes. The food colorings are likely responsible for the trashing of millions of dollars worth of nylon carpet annually, with the colors red 40 and red 3 being some of the more notorious culprits. Though it is sometimes possible to remove the food coloring, it is also possible that the carpet dye will be removed at the same time.

Another problem with the dyes used to color nylon fibers is that they are readily oxidized by chlorine bleach and certain peroxides. Strong bases may reduce one or more of the dyes, either altering or bleaching the color. The damage to carpets caused by inadvertent spills of chlorine bleach, peroxides and strongly basic solutions may be as great as the damage caused by food colorings and other equally persistent stains.

As an alternative to replacing the entire carpet, carpet care professionals have developed certain methods for redyeing the bleached spots. The spot dying methods typically use the same types of acid dyes used by the manufacturers to impart the original color to the carpets. Typically, the conventional redyeing methods employ a color chart or color wheel, and require that a carpet matching spot dye be formulated by combining selected basic dye colors in the proper proportions. Spot dyeing kits are also available that use only the three primary dye colors: red, yellow and blue. The known kits suggest that the dyer begin with the primary color closest to the unbleached carpet color. The major problem with such redyeing methods is that accurate color matching requires a high degree of skill and compentency, as well as luck. In addition, the method suggested whereby the first primary color to be used is the one closest to the unbleached carpet color is flawed, as the suggested primary color may not have been removed by bleaching. As will be hereinafter explained, adding the suggested primary color may simply result in addition of too much of the main primary color dye and make it impossible to achieve a close match.

Although there is a great demand for competent spot dyers, the conventional spot dyeing processes have become so complex, that few individuals are sufficiently patient to learn the required skills. Twenty or more years ago, carpet colors were few and often close in color to a primary color. The then prevailing redyeing method was to use a primary color closest to the original color, and then use color theory to create a match. Though the concept is still in use today, it does not take into consideration that carpet colors are seldom close to a primary color. Additionally, many carpets are so lightly colored that the closest primary color is difficult to determine. As more shades of carpet became available, more color samples were added to spot dyeing kits. As the number of dye colors in spot dyeing kits proliferated, the kits became more expensive and more difficult to competently use. Each carpet is typically dyed with at least two, and typically, three primary dyes, each of which has its own susceptibility to a particular bleaching agent. As a general rule, when a spot on a carpet is bleached, each of the primary dyes affected differently. For example, a particular bleach may oxidize the primary red color, but have less of an effect on the blue and yellow primary dyes. It a spot dyeing kit were to contain 60 different colors, and a bleached spot on a carpet were missing only one of three primary colors, using a formulation which matched the original color would result in a color mismatch for the area being repaired. All of the foregoing factors combine to make spot dying using conventional techniques a formidable task.

U.S. Pat. No. 6,533,824 to the same inventor discloses a method for restoring original color to bleached regions of nylon carpets. This patent is incorporated herein by reference. Prior to the redyeing process, the area to be treated is subjected to several rinse and extract steps. A bleach neutralizer is then applied, allowed to remain on the area to be treated for about 5 minutes, then extracted without further rinsing. Dilute primary color dyes are applied using a spray bottle. For most bleached spots, which will have either white, yellow, or orange hues, the redyeing sequence generally begins with dilute primary blue dye. However, if the bleached spot were to have a blue or green hue, the sequence would preferably begin with dilute primary red dye. On the other hand, if the bleached spot were to have a purple or lavender hue, the sequence would preferably begin with dilute primary yellow. Based on the color of the spot, the bleached area is then sprayed with the appropriate dilute primary color dye, which is then vacuum extracted without rinsing. The spray and extract process is repeated until either the desired color is obtained or the slightest tinge away from the color to be matched is observed. For each primary color dye, it is best to under-dye the area rather than over-dye it for the first application of a particular primary color dye. As the spot changes color, the remaining two primary colors are employed in an order as though the redyeing process were just beginning.

Although the heretofore described method is effective, it is somewhat time consuming. In addition, when employing the method, it is difficult to prevent dye from coming in contact with unbleached fibers around the perimeter of the bleached spot. Thus, there is a tendency to add unneeded dye to a band of unbleached fibers which surround the bleached spot. What is needed is an improved spot dyeing process that is not only faster, but far more accurate with respect to proper placement of the needed primary dye colors.

The use of colored wax crayons to recolor bleached spots has become rather popular as of late. This is because crayons are easy to use and the recoloring process can be done quickly. However, the use of crayons results in the "repaired" spot having a different look and feel than the original carpet. The recolored area has a waxy coat. The colored wax is a surface dye that is partially removed during steam and hot water cleaning. An even more significant problem is that when heat is applied to a spot that has been recolored with crayons, the dye in the wax may actually chemically bond to the carpet fibers, resulting in a color change that is worse than when bleached.

SUMMARY OF THE INVENTION

The invention is a new method of delivering more precise amounts of carpet mill dye to regions of discoloration. Use of a roller-ball applicator enables precisely metered delivery of the three primary dye colors to the discolored carpet fibers. Not only does it enable the restoration of a more uniform color pattern by making it easier to achieve a correct ratio of primary colors, it eliminates dye overspray outside of the region to be restored that is inherent with the use of a spray bottle. The method also eliminates the need for a water extraction machine.

The process involves the use of the three primary colors of dye. Carpet mill dyes are converted into a stable liquid dye solution by adding equal parts of $H_2O$ and 91% Isopropyl Alcohol. The alcohol prevents gradual clumping that occurs when acid dyes are dissolved in water. Each solution is then placed in a 10 or 15 ml bottle equipped with a roller-ball applicator. The roller balls are preferably made of stainless steel or glass. When applying carpet mill dye, the bottle with the roller-ball applicator is held with a loose grip. The roller ball of the applicator, while in contact with the carpet fibers to be dyed, is alternately moved in clockwise and counterclockwise directions. This ensures that dye is delivered to all sides of the fiber. To ensure even dye penetration and improved motion within the metal or glass roller ball, an emulsifier is added to the dye solution. Carbomer, a cross-linked polyacrylate polymer, is presently the preferred emulsifier. It is an easy-to-use water soluble polymer that is widely used as an emulsifying, stabilizing, suspending, thickening and gelling agent in myriad applications because it is both versatile and safe. Carbopol® 940 is a trademarked brand of carbomer. Carbomer is added to the dye-water-alcohol mixture within a range of 0.25 grams/liter to 5 grams/liter. In order to effect proper mixing of the carbomer with the mixture, a high-speed blender is a virtual necessity. The BlendTec® Total Classic Blender, which is equipped with a motor rated at 3.0 peak horsepower, is highly effective for this purpose.

Emulsifiers are used to maintain a uniform dispersion of one liquid in another, such as oil in water. The basic structure of an emulsifying agent includes a hydrophobic portion, which is usually a long-chain fatty acid, and a hydrophilic portion that may be either charged or uncharged. The hydrophobic portion of the emulsifier dissolves in the oil phase, and the hydrophilic portion dissolves in the aqueous phase, forming a dispersion of small oil droplets. Emulsifiers thus form and stabilize oil-in-water emulsions. The emulsifier allows non-polar acid dyes to be suspended in an alcohol-containing aqueous solution. The emulsifier also slows the bonding of acid dyes to the nylon or wool fibers. This ensures a more uniform dye application once a damp microfilament cloth is wiped across the area. The microfilament cloth minimizes carpet fiber distortion. When a damp microfilament cloth is gently rubbed on the nylon fibers, The hydrophobic tail of the emulsifier transfers to the microfilament cloth, thereby enabling the acid dye to more freely bond to the nylon or wool fibers.

Achieving an exact color match involves replacing only the missing primary colors in the correct ratio. This is accomplished by adding primary colors in a controlled amount. As dye is applied, the discoloration is carefully monitored for a color shift.

Roller-ball applicators may be employed to dispense a number of solutions used in carpet restoration, including citric acid solutions and sodium thiosulfate solutions.

DETAILED DESCRIPTION OF THE PREFERRED EMBODIMENT

As heretofore explained, traditional methods of restoring proper color to bleached regions of carpet utilize dilute primary color carpet mill dyes, which are applied by a spray bottle. The excess water is then removed by an extraction machine and the discoloration is monitored. Achieving an exact color match involves replacing only the missing primary colors in the correct ratio. This is accomplished by adding primary colors in a controlled amount. As dye is applied, the discoloration is carefully monitored for a color shift. A determination is made in continuing with the same dye color or applying a different primary color. Using a roller ball, the same amount of dye is delivered without the excess water. Both methods utilize the same principle in deriving at a correct color match. That is to say, the color of the bleached area at any given time determines the primary color used. When any change of color is noted, then the primary color used is always determined by that discoloration. For example the appearance of blue or green would indicate red dye is to be applied. For the appearance of lavender, yellow dye is applied. Blue dye is applied when a yellow, orange, or salmon colored is noted.

Figure 1:
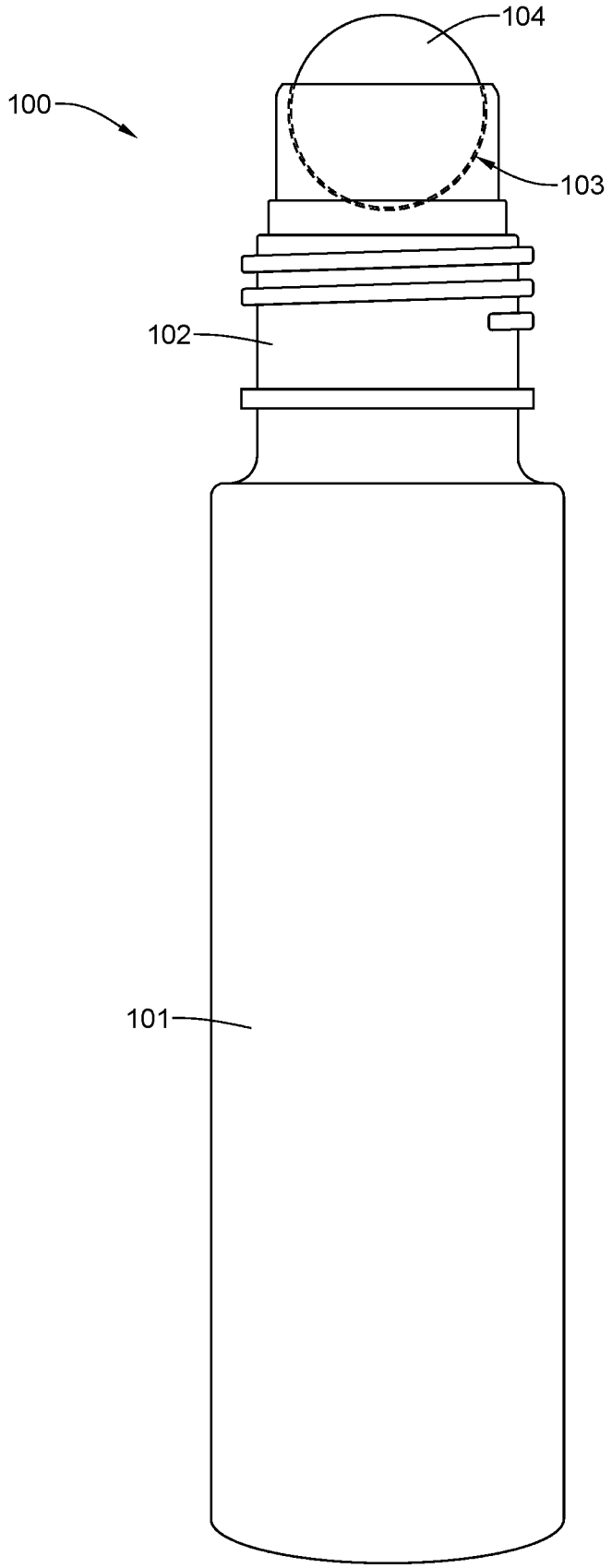
FIG. 1 is a roller-ball applicator having a glass storage vessel.

Referring now to FIG. 1, a first roller-ball applicator 100 includes a glass bottle 101 having a capacity of about 10 ml and a cap 102 preferably made of high-density polyethylene. The cap 102 has a truncated cylindrical socket 103 into which has been snapped a roller ball 104, which has a diameter of about 1 cm. The first roller-ball applicator 100 is a preferred applicator for bleached spots greater than about 25 mm in diameter.

Figure 2:
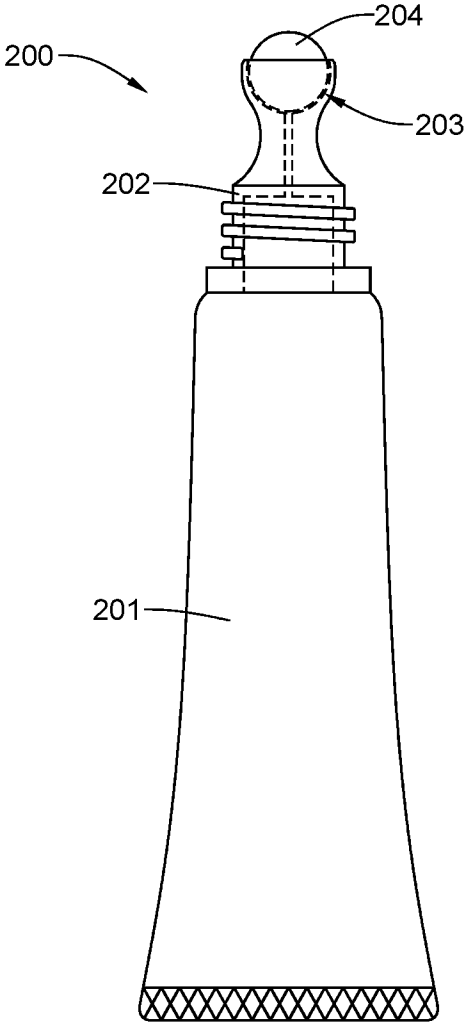
FIG. 2 is a roller-ball applicator having a deformable storage tube.

Referring now to FIG. 2, a second roller-ball applicator 200 includes a squeezable supply tube 201 preferably made of low-density polyethylene. The squeezable supply tube has a capacity of about 2 ml. A cap 202, which is preferably made of high-density polyethylene, has a truncated spherical socket 203 into which is snapped a stainless steel roller ball 204 having a diameter of about 3 mm. The second roller-ball applicator 200 is a preferred applicator for bleached spots having a diameter less than about 25 mm.

Figure 3:
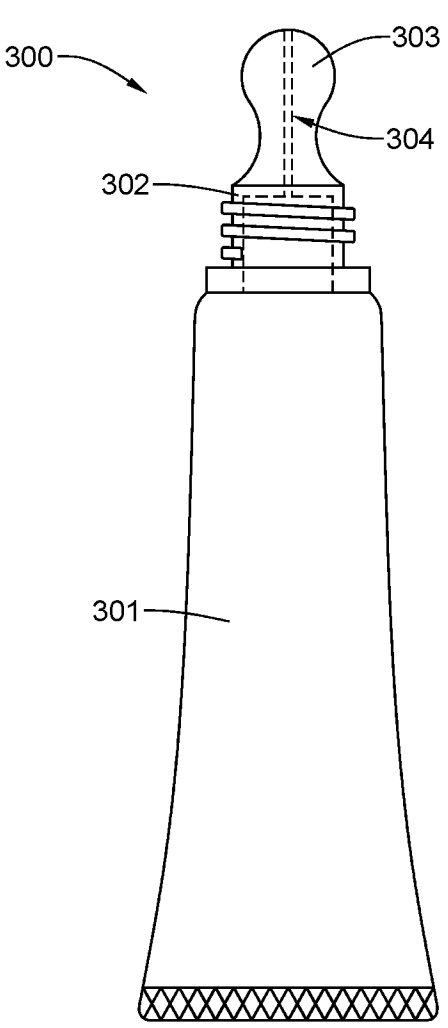
FIG. 3 is dome applicator having a deformable storage tube.

Referring now to FIG. 3, a dome applicator 300 includes a squeezable supply tube 301 preferably made of low-density polyethylene. The squeezable supply tube has a capacity of about 2 ml. A cap 302, which is preferably made of high-density polyethylene, has a dome tip 303 which has a diameter of about 3 mm. The dome applicator 300 is an alternative to the second roller-ball applicator 200 and is useful for recoloring bleached spots having a diameter less than about 25 mm. The dome tip 303 is equipped with a central aperture 304 that leads directly to the liquid supply within the squeezable supply tube 301. Thus, release of dilute liquid dye from the dome tip the dome applicator 300 is more difficult to control because it is not modulated by rotation of a roller-ball, as is the case with the first and second roller-ball applicators 100 and 200, respectively.

The advantages of using a roller-ball application method over using spray bottles are numerous and impressive. For one, the required three roller-ball applicators becomes the storage containers for the three primary dye color mixtures. There is no need for spray bottles or for a water extraction machine. With less water on the work area, the color loss area is easier to see. This minimizes the chances of going too dark or getting a non-uniform color. An over-spray pattern is also avoided.

An eye dropper, also known as a Pasteur pipette, or dropper, is a device used to transfer small quantities of liquids. They are used in the laboratory and also to dispense small amounts of liquid medicines. Pasteur pipettes can deliver small amounts of aqueous solutions to carpet fibers during the recoloring process and can substitute for the dome applicator 300. After dispensing a desired amount of aqueous solution in the discolored region, the tube of the dropper can be held between the thumb and index finger and the tip of the dropper can be moved in alternately clockwise and counterclockwise directions to fully wet all sides of the carpet fibers being treated.

Using the roller-ball and dome applications, as well as the Pasteur pipette, the carpet recoloring process is simpler, with fewer steps involved, making the process is less intimidating and easier to understand. Because of uncertainty, many individuals choose methods that do not produce excellent results. One such method involves the use of crayons. These actually create more problems. The reduction of uncertainty makes the use of a roller ball applicator the better choice.

Wool carpeting can be challenging when restoring color as over wetting will result in the fibers going brown. This can be avoided by using the roller ball method. Wool and nylon carpeting will also dry much quicker. From a marketing standpoint, a recoloring kit based on the new method is easier to manufacture, package and sell.

Permanent stains on a carpet can be bleached using the roll-on applicator. This allows for controlled bleaching. Just as proper color can be gradually restored to a carpet, colors that make up a stain can be gradually removed. This results in the stain being removed with minimal color loss to the actual carpet. Over applying a bleaching agent with a spray bottle will remove more color than what is desired. It will also increase the size of the color loss area. The use of anti-bleaching agents are reduced when less chemicals are used to remove stains.

Before removing a stain by a bleaching process, all efforts should be made in removing the stain first by a carpet shampoo spotter. In most cases individuals by habit would use more shampoo than is required. Removing the shampoo completely takes time and is often left in the carpet. In this case, less is better. Over months this spotter will chemically alter the carpet. When the carpet is cleaned, a region of discoloration appears. This can be prevented by using only the amount of carpet shampoo spotter needed. We therefore would use the roll-on applicator as a carpet spotter for removing stains. This could be used in removing stains from upholstery or even clothing.

It should also be noted that the use of roller-ball applicators can also be used in conjunction with any method using carpet mill dyes.

The recoloration method using roller-ball applicators excels in removing partial bleach spots. These require very little dye for restoration of the original color. The process is very accurate and quick. Repair of the bleached spot is permanent, and the repaired spot will not change color when cleaned. The look and feel is the same as the original carpet. There is no need to mix dyes, set up spray bottles with an extractor machine. The instructions are simple.

The process involves the use of the three primary colors of dye. Carpet mill dyes are converted into a stable liquid dye solution by adding equal parts of $H_2O$ and 91% Isopropyl Alcohol. The alcohol prevents gradual clumping that occurs when acid dyes are dissolved in water. Each solution is then placed in a 10 or 15 ml bottle equipped with a roller-ball applicator. The roller balls are preferably made of stainless steel or glass. When applying carpet mill dye, the bottle with the roller-ball applicator is held with a loose grip. The roller ball of the applicator, while in contact with the carpet fibers to be dyed, is alternately moved in clockwise and counterclockwise directions. This ensures that dye is delivered to all sides of the fiber. To ensure even dye penetration and improved motion of the metal or glass roller ball in its socket, an emulsifier is added to the dye solution. Carbomer, a cross-linked polyacrylate polymer, is presently the preferred emulsifier. It is an easy to use water soluble polymer that is widely used as an emulsifying, stabilizing, suspending, thickening and gelling agent in myriad applications because it is both versatile and safe. Carbopol® 940 is a trademarked brand of carbomer. Carbomer is added to the dye-water-alcohol mixture within a range of 0.25 grams/liter to 5 grams/liter. In order to effect proper mixing of the carbomer with the mixture, a high-speed blender is a virtual necessity. The BlendTec® Total Classic Blender, which is equipped with a motor rated at 3.0 peak horsepower, is highly effective for this purpose.

Emulsifiers are used to maintain a uniform dispersion of one liquid in another, such as oil in water. The basic structure of an emulsifying agent includes a hydrophobic portion, which is usually a long-chain fatty acid, and a hydrophilic portion that may be either charged or uncharged. The hydrophobic portion of the emulsifier dissolves in the oil phase, and the hydrophilic portion dissolves in the aqueous phase, forming a dispersion of small oil droplets. Emulsifiers thus form and stabilize oil-in-water emulsions. The emulsifier allows non-polar acid dyes to be suspended in an alcohol-containing aqueous solution. The emulsifier also slows the bonding of acid dyes to the nylon or wool fibers. This ensures a more uniform dye application once a damp microfilament cloth is wiped across the area. The microfilament cloth minimizes carpet fiber distortion. When a damp microfilament cloth is gently rubbed on the nylon fibers, The hydrophobic tail of the emulsifier transfers to the microfilament cloth, thereby enabling the acid dye to more freely bond to the nylon or wool fibers.

Different chemicals involved in restoring carpet color may also be applied with the roll-on applicator bottles with better results. Pet urine, as it is converted to ammonia, will raise the PH of the stain and remove color. Citric acid is used to lower pH and stabilize the color in areas where pets have urinated. The citric acid can be applied using a roller-ball applicator. Excess citric acid is not needed. Because carbomer can be used as a gelling agents for solutions which are pH neutral (i.e., pH=7), different gelling agents must be used for citric acid solutions. Guar gum powder is one such gelling agent that is compatible with citric acid solutions. Guar gum, also called guaran, is a galactomannan polysaccharide extracted from guar beans that has thickening and stabilizing properties useful in the food, feed and industrial applications. The guar seeds are mechanically dehusked, hydrated, milled and screened according to desired application.

Sodium thiosulfate is used to neutralize sodium hypochlorite (the active ingredient in chlorine bleach). This is sold as a bleach neutralizer and is used to prevent or minimize color loss when sodium hypochlorite has been spilled on a carpet. Sodium thiosulfate is also used when correcting a spot of discoloration. Standard practice has typically been to saturate a bleached spot with a sodium thiosulfate solution. However, because the chemical neutralization reaction occurs within the carpet fibers themselves, there is no need to apply excess bleach neutralizer to the carpet. Use of a roller-ball applicator containing a solution of sodium thiosulfate enables a much more measured and controlled application sodium thiosulfate solution to the spot, thereby eliminating the need to apply excess bleach neutralizer. Like citric acid, sodium thiosulfate cannot be gelled using carbomer. However, guar gum powder is an effective gelling agent for sodium thiosulfate solutions.

The inventor serendipitously discovered that when sodium thiosulfate is combined with guar gum powder, the effectiveness of sodium thiosulfate is greatly increased. The ability of sodium thiosulfate to remain in a solution is enhanced, thus higher concentrations of sodium thiosulfate can be made. Using the roller ball applicator or even an eye dropper to neutralize chlorine is far more effective than when the guar gum is added to an aqueous solution of sodium thiosulfate, as more sodium thiosulfate is in direct contact with the carpet fibers.

Although only three types of applicators for use in restoration of stained and bleached carpet are shown and described, it will be obvious to those having ordinary skill in the art that changes and modifications may be made thereto without departing from the scope and the spirit of the invention as hereinafter claimed.

The invention claimed is:

1. A method for delivering precise amounts of liquid selected from the group consisting of carpet mill dye, a carpet fiber bleaching agent, and a bleach neutralizer, to a discolored region of a carpet, said method comprising the following sequence of steps:

providing a plurality of roller-ball applicators, one of which contains red carpet mill dye, another of which contains yellow carpet mill dye, yet another of which contains blue carpet mill dye, still another of which contains the carpet fiber bleaching agent, and finally another of which contains a bleach neutralizer;

if the discolored region has been stained, then, using the roller-ball applicator filled with the carpet fiber bleaching agent, gradually remove the stain by alternately moving the roller ball in clockwise and counter-clockwise directions, with the roller-ball of the applicator in contact with the carpet fibers that have been stained, thereby delivering the enclosed carpet fiber bleaching agent to all sides of the carpet fibers in said stained, discolored region;

wiping a microfilament cloth across the fibers to which the carpet fiber bleaching agent has been applied using the selected applicator;

if the discolored region of the carpet has been bleached, either accidentally or in order to remove the stain, then the bleach neutralizer is applied to the bleached region with the roller-ball applicator containing the bleach neutralizer by alternately moving the roller ball in clockwise and counter-clockwise directions, with the roller-ball of the applicator in contact with the carpet fibers that have been bleached, thereby delivering the bleach neutralizer to all sides of the carpet fibers in said discolored region;

wiping a microfilament cloth across the fibers to which the bleach neutralizer has been applied;

selecting a roller-ball applicator containing an appropriate first carpet mill dye color to begin a process for adding a proper combination of primary dyes to the carpet fibers in the discolored region, the addition of said first carpet mill dye color accomplished by alternately moving the roller ball in clockwise and counter-clockwise directions, with the roller-ball of the applicator in contact with the carpet fibers that have been stained, thereby delivering the first carpet mill dye color to all sides of the carpet fibers in said stained, discolored region;

wiping a microfilament cloth across the fibers to which the first carpet mill dye color was applied;

selecting a roller-ball applicator containing an appropriate second carpet mill dye color to begin a process for adding a proper combination of primary dyes to the carpet fibers in the discolored region, the addition of said second carpet mill dye color accomplished by alternately moving the roller ball in clockwise and counter-clockwise directions, with the roller-ball of the applicator in contact with the carpet fibers that have been stained, thereby delivering the second carpet mill dye color to all sides of the carpet fibers in said discolored region;

wiping a microfilament cloth across the fibers to which the second carpet mill dye color was applied;

if required, select a roller-ball application ontaining an appropriate third mill dye color and apply to the discolored regions as heretofore described, followed by a wiping of a microfilament cloth across the fibers to which the third carpet mill dye color was applied.

2. The method of claim 1, wherein an emulsifier is added to each dye solution and to the bleaching agent, which promotes even penetration of the liquid and improved motion of the roller ball of the selected applicator.

3. The method of claim 2, wherein said emulsifier is a cross-linked polyacrylate polymer known as carbomer.

4. The method of claim 1, wherein said bleaching agent is an aqueous solution of sodium hypochlorite.

5. The method of claim 1, wherein the bleach neutralizer is a sodium thiosulfate solution.

6. The method of claim 5, wherein guar gum powder is added to the sodium thiosulfate solution.

7. A method for delivering precise amounts of liquid selected from the group consisting of carpet mill dye, a carpet fiber bleaching agent, and a bleach neutralizer, to a discolored region of a carpet, said method comprising the steps of:

providing a plurality of roller-ball applicators, one of which contains red carpet mill dye, another of which contains yellow carpet mill dye, yet another of which contains blue carpet mill dye, still another of which contains the carpet fiber bleaching agent, and finally another of which contains the bleach neutralizer;

if the discolored region has been stained, then, using the roller-ball applicator filled with the carpet fiber bleaching agent, gradually remove the stain by alternately moving the roller ball in clockwise and counter-clockwise directions, with the roller-ball of the applicator in contact with the carpet fibers that have been stained, thereby delivering the enclosed carpet fiber bleaching agent to all sides of the carpet fibers in said stained, discolored region;

if the discolored region of the carpet has been bleached, either accidentally or in order to remove the stain, then the bleach neutralizer is applied to the bleached region with the roller-ball applicator containing the bleach neutralizer by alternately moving the roller ball in clockwise and counter-clockwise directions, with the roller-ball of the applicator in contact with the carpet fibers that have been bleached, thereby delivering the bleach neutralizer to all sides of the carpet fibers in said discolored region;

selecting a roller-ball applicator containing an appropriate first carpet mill dye color to begin a process for adding a proper combination of primary dyes to the carpet fibers in the discolored region, the addition of said first carpet mill dye color accomplished by alternately moving the roller ball in clockwise and counter-clockwise directions, with the roller-ball of the applicator in contact with the carpet fibers that have been stained, thereby delivering the first carpet mill dye color to all sides of the carpet fibers in said stained, discolored region;

selecting a roller-ball applicator containing an appropriate second carpet mill dye color to begin a process for adding a proper combination of primary dyes to the carpet fibers in the discolored region, the addition of said second carpet mill dye color accomplished by alternately moving the roller ball in clockwise and counter-clockwise directions, with the roller-ball of the applicator in contact with the carpet fibers that have been stained, thereby delivering the second carpet mill dye color to all sides of the carpet fibers in said discolored region;

if required, select a roller-ball application ontaining an appropriate third mill dye color and apply to the discolored regions as heretofore described; and wiping a microfilament cloth across the carpet fibers of the discolored regions each time liquid is applied to those fibers using a roller-ball applicator.

8. The method of claim 7, wherein an emulsifier is added to each dye solution and to the bleaching agent, which promotes even penetration of the liquid and improved motion of the roller ball of the selected applicator.

9. The method of claim 8, wherein said emulsifier is a cross-linked polyacrylate polymer known as carbomer.

10. The method of claim 7, wherein said bleaching agent is an aqueous solution of sodium hypochlorite.

11. The method of claim 7, wherein the bleach neutralizer is a sodium thiosulfate solution.

12. The method of claim 11, wherein guar gum powder is added to the sodium thiosulfate solution.

13. A method for delivering precise amounts of aqueous solutions of mill dye, a carpet fiber bleaching agent, and a bleach neutralizing agent, to a discolored region of a carpet during a multi-step color restoration procedure, said method comprising the steps of:

employing a plurality of roller-ball applicators to dispense said precise amounts, and wherein an applicator tip of the instrument is alternately moved in clockwise and counter-clockwise directions, with the tip in contact with the carpet fibers in the discolored region, thereby delivering the aqueous solutions to all sides of the carpet fibers in said region; and wiping a microfilament cloth across the carpet fibers of the discolored regions each time an aqueous solution is applied to those fibers.

14. The method of claim 13, wherein an emulsifier is added to each dye solution and to the bleaching agent, which promotes even penetration of the liquid and improved motion of the roller ball of the selected applicator.

15. The method of claim 14, wherein said emulsifier is a cross-linked polyacrylate polymer known as carbomer.

16. The method of claim 13, wherein said bleaching agent is an aqueous solution of sodium hypochlorite.

17. The method of claim 13, wherein the bleach neutralizer is a sodium thiosulfate solution.

18. The method of claim 17, wherein guar gum powder is added to the sodium thiosulfate solution.

* * * * *